US009695370B2

(12) United States Patent
Anderson et al.

(10) Patent No.: US 9,695,370 B2
(45) Date of Patent: Jul. 4, 2017

(54) CORROSION INHIBITION

(71) Applicant: Petroliam Nasional Berhad (Petronas), Kuala Lumpur (MY)

(72) Inventors: Kris Anderson, Kuala Lumpur (MY); Peter Goodrich, Belfast (GB); Christopher Hardacre, Belfast (GB); Azlan Hussain, Kuala Lumpur (MY); David Rooney, Belfast (GB)

(73) Assignee: PETROLIAM NASIONAL BERHAD (PETRONAS), Kuala Lumpur (MY)

( * ) Notice: Subject to any disclaimer, the term of this patent is extended or adjusted under 35 U.S.C. 154(b) by 261 days.

(21) Appl. No.: 14/360,144

(22) PCT Filed: Nov. 23, 2012

(86) PCT No.: PCT/GB2012/052913

§ 371 (c)(1),
(2) Date: Mar. 4, 2015

(87) PCT Pub. No.: WO2013/076509

PCT Pub. Date: May 30, 2013

(65) Prior Publication Data

US 2014/0371495 A1 Dec. 18, 2014

(30) Foreign Application Priority Data

Nov. 25, 2011 (GB) ..... 1120391.6

(51) Int. Cl.

| | |
|---|---|
| ***C10G 75/02*** | (2006.01) |
| ***C10G 7/10*** | (2006.01) |
| ***C10G 21/27*** | (2006.01) |

(52) U.S. Cl.

CPC ..... *C10G 75/02* (2013.01); *C10G 7/10* (2013.01); *C10G 21/27* (2013.01); *C10G 2300/203* (2013.01)

(58) Field of Classification Search

None

See application file for complete search history.

(56) References Cited

U.S. PATENT DOCUMENTS

| | | | |
|---|---|---|---|
| 4,292,183 | A | 9/1981 | Sanders |
| 4,971,724 | A | 11/1990 | Kalota et al. |
| 5,252,254 | A | 10/1993 | Babaian-Kibala |
| 5,531,934 | A | 7/1996 | Freeman et al. |
| 5,552,085 | A | 9/1996 | Babaian-Kibala |
| 5,630,964 | A | 5/1997 | Babaian-Kibala et al. |
| 5,863,415 | A | 1/1999 | Zetlmeisl |
| 6,585,933 | B1 | 7/2003 | Ehrhardt et al. |
| 6,706,669 | B2 | 3/2004 | Sartori et al. |
| 2008/0001125 | A1 | 1/2008 | Zetlmeisl et al. |
| 2012/0186993 | A1* | 7/2012 | Huang ..... B01D 53/1425 205/687 |

FOREIGN PATENT DOCUMENTS

| | | |
|---|---|---|
| EP | 0607640 | 1/1993 |
| EP | 1333108 | 1/2003 |
| GB | 2027686 | 2/1980 |

OTHER PUBLICATIONS

Likhanova et al. "The effect of ionic liquids with imidazolium and pyridinum cations on the corrosion inhibition of mild steel in acidic environment", Corrosion Science, vol. 52, Jun. 1, 2010, pp. 2088-2097.*

Factors Controlling Naphthenic Acid Corrosion, Tumbull et al (Corrosion, 1998, vol. 54, p. 922).

* cited by examiner

*Primary Examiner* — Tam M Nguyen

(74) *Attorney, Agent, or Firm* — Ryan T. Grace; Advent, LLP

(57) ABSTRACT

The invention relates to a method of inhibiting corrosion by corrosive fluids, and more specifically to inhibiting corrosion of a metallic surface. The method comprising adding to the corrosive fluid a specifically selected ionic liquid which is added in an amount, based on the total weight of the corrosive fluid, effective to mitigate or alleviate corrosion.

23 Claims, No Drawings

CORROSION INHIBITION

This invention relates to methods of inhibiting corrosion by corrosive fluids. In particular, the invention relates to methods of inhibiting acid corrosion of metal surfaces by corrosive fluids, such as acidic hydrocarbon fluids, acidic aqueous fluids and salt solutions, by the use of carefully selected ionic liquids.

Many hydrocarbon fluids, such as crude oils and crude oil distillates, contain corrosive quantities of acidic substances. In particular, the acidity of crude oils and crude oil distillates is often largely due to the presence of naphthenic acids and/or sulfur containing acids. The term "naphthenic acids" encompasses a large number of carboxylic acid compounds comprising one or more cycloalkyl rings and having a molecular weight in the range of from about 120 to well over 700. The majority of naphthenic acids found in crude oils and crude oil distillates have a carbon backbone comprising 9 to 20 carbon atoms and cyclopentyl rings are the predominant cycloalkyl ring structure, although other cycloalkyl rings, such as cyclohexyl and cycloheptyl rings may be present in appreciable amounts.

The acidity of crude oils and crude oil distillates is measured in terms of the Total Acid Number (TAN) in accordance with ASTM D0664. The Total Acid Number is the amount of potassium hydroxide in milligrams that is needed to neutralize the acid in one gram of oil, with values in excess of 0.5 mg KOH/g being indicative of high acidity. Typical TAN values for acidic crude oils and crude oil distillates are in the range of 0.5 to 4.0 mg KOH/g, while acidic distillate fractions such as kerosene may have TAN values in the range of, for example, 0.5 to 8.0 mg KOH/g.

The presence of acidic impurities in crude oils and crude oil distillates can cause significant problems due to corrosion of metal surfaces of pipelines and refinery equipment. Acid corrosion is a particular problem in distillation apparatus and condensers where elevated temperatures lead to an increased rate of corrosion as well as the concentration of acids in certain distillate fractions. Naphthenic acid corrosion is a particular problem at temperatures in the range of from 150° C. to 450° C. which are typically used in conventionally crude oil distillation processes.

A number of approaches have been proposed to address the problem of corrosion due to the acidity of crude oils and crude oil distillates. These include removing or neutralising the acidic components of the crude oil/crude oil distillate; blending high TAN crude oils/crude oil distillates with low TAN crude oils/crude oil distillates so as to reduce the overall acidity; and the use of corrosion-resistant materials, typically high quality stainless steel or other alloys of iron with chromium and/or molybdenum, in the construction of oil refinery apparatus. However, each of these approaches has significant disadvantages in terms of cost and commercial feasibility. Removal of acids from crude oils/crude oil distillates adds additional processing steps which adds to the cost of the refinery operation; blending techniques rely on the availability of low acidity crude oils/crude oil distillates; and the use of corrosion-resistant materials usually adds significantly to the capital cost of constructing and maintaining refinery facilities.

A further approach that has been explored is the use of additives which are added to the hydrocarbon fluid prior to refinery processing. These additives, known as corrosion inhibitors, reduce the level of acid corrosion by passivation of susceptible metal surfaces of the refinery equipment and/or by modifying the reactivity of the acidic components of the hydrocarbon fluid. The corrosion inhibitors that have been proposed to date are largely based on phosphorus and sulfur.

Turnbull et al. (Corrosion, 1998, volume 54, page 922) discloses the use of hydrogen sulfide to inhibit corrosion of steel by oils containing naphthenic acids. However, this approach has limited application in practice due to the toxicity of hydrogen sulfide and because hydrogen sulfide itself becomes corrosive at elevated temperatures. Other sulfur-containing compounds that have been proposed as corrosion inhibitors include sulfonated alkylphenols (U.S. Pat. No. 5,252,254), polysulfides (EP 0607640), and tertiary mercaptans (US 2008/0001125). However, one disadvantage of the use of sulfur-based corrosion inhibitors is that the sulfur content of most hydrocarbon products is subject to strict controls and it may therefore be necessary to implement sulfur removal stages before the refined hydrocarbon product is suitable for commercial use.

In addition, the reactive sulfur groups, such as sulfides and mercaptans, which are essential to obtain the corrosion-inhibiting properties of these compounds, are also highly reactive catalyst poisons towards many of the catalysts used in the processing of hydrocarbon fluids. Hence, the use of such inhibitors is incompatible with downstream catalytic processing, Among the phosphorus-containing compounds which have been proposed as corrosion inhibitors for hydrocarbon processing are phosphate esters (EP 1333108) and phosphorous acid (U.S. Pat. No. 6,706,669). In addition, a number of proposed corrosion inhibition techniques are based on the use of compounds that contain both phosphorus and sulfur, for instance alkyldithiophosphoric acid, thiophosphonic acid, and derivatives thereof (U.S. Pat. No. 5,863,415), and thiophosphate and thiophosphite esters (U.S. Pat. No. 5,552,085 and US 2008/0001125). The combined use of sulfur-containing compounds with phosphate esters has also been proposed (U.S. Pat. No. 5,630,964). However, these compounds also share the disadvantage that the phosphorus-containing functional groups (such as phosphates, phosphites, thiophosphate and thiophosphites) necessary to obtain the corrosion inhibiting properties of these compounds are catalysts poisons, and thus the use of these corrosion inhibitors is incompatible with downstream catalytic processing of the hydrocarbon fluids.

Corrosion inhibition is also an important factor in the handling of acidic aqueous fluids and aqueous salt solutions (such as brines), for example during the transportation, storage and processing of industrial fluid feeds and wastewaters.

U.S. Pat. No. 6,585,933 discloses the use of tetrazolium salts having anions which are conjugate bases of strong mineral acids, such as halogens, nitrates and sulfates, for inhibiting corrosion by aqueous systems having a pH ranging from mildly acidic (about pH 5) to strongly alkaline (about pH 12).

U.S. Pat. No. 4,971,724 discloses the use of certain amino acids, such as aspartic acid, as corrosion inhibitors. However, the amino acids are only effective inhibitors of corrosion at alkaline pH when in fully ionised form (i.e. pH 9.5 or greater). Below a pH of around 9.5 the amino acids are said to increase corrosion when compared to systems containing no corrosion inhibitor. Accordingly, these systems are ineffective for preventing acid corrosion.

U.S. Pat. No. 5,531,934 discloses that certain poly(amino acids) and copolymers of amino acids with having molecular weight in the range of from 1000 to 100,000 are effective at inhibiting corrosion by aqueous fluids having a pH of from 3 to 12.

Salt solutions, such as brines, are corrosive as they can significantly increase the rate of anodic oxidation of metals in the presence of oxygen gas. U.S. Pat. No. 4,292,183 discloses amine-based compounds which are said to be effective corrosion inhibitors when added to brines. GB 2027686 discloses the use of water-soluble thiocyanates or thioamides as inhibitors of corrosion by brine, either alone or in combination with inhibitor aids selected from quaternary pyridinium, quinolinium or isoquinolinium halide salts. However, the quaternary pyridinium, quinolinium or isoquinolinium halide salts show negligible inhibition of corrosion when used alone.

The term "ionic liquid" as used herein refers to a liquid that is capable of being produced by melting a solid, and when so produced consists solely of ions. The term "ionic liquid" includes both compounds having high melting temperature and compounds having low melting points, e.g. at or below room temperature (i.e. 15 to 30° C.). The latter are often referred to as "room temperature ionic liquids" and are often derived from organic salts having pyridinium- and imidazolium-based cations. A feature of ionic liquids is that they have particularly low (essentially zero) vapour pressures. Many organic ionic liquids have low melting points, for example, less than 100° C., particularly less than 80° C., and around room temperature, e.g. 15 to 30° C., and some have melting points well below 0° C.

An ionic liquid may be formed from a homogeneous substance comprising one species of cation and one species of anion, or it can be composed of more than one species of cation and/or anion. Thus, an ionic liquid may be composed of more than one species of cation and one species of anion. An ionic liquid may further be composed of one species of cation, and more than one species of anion.

Ionic liquids generally exhibit a set of appealing physicochemical characteristics that typically include extremely low vapour pressure, wide liquid range, non-degradability, non-flammability, good thermal stability and excellent ability to solubilise a large range of compounds. Due to the potential for controlling the properties of ionic liquids by judicious choice of the constituent ions, and the multiple combinations of ions that can result in low-melting salts, ionic liquids have been proposed for a broad range of applications.

It has now surprisingly been found that certain carefully chosen ionic liquids are highly effective at inhibiting corrosion of metals by corrosive fluids. Due to their lack of vapour pressure, the ionic liquids are readily separable from other components of the fluids during refining (e.g. by distillation). In addition, it has been found that the ionic liquid corrosion inhibitors may be used in very low quantities (for instance at or below 100 ppm wt.) while retaining effective corrosion inhibition properties.

Furthermore, in preferred embodiments, the ionic liquids used in the methods of the invention are substantially free of reactive sulfur- and phosphorus-containing functional groups, such as sulfide, phosphate, thiophosphate and thiophosphite moieties, which can poison the catalysts used in conventional hydrocarbon processing operations. By substantially free, it is meant that the ionic liquids comprise less than 10 wt % of reactive sulfur- and phosphorus-containing functional groups, preferably less than 5 wt %, more preferably less than 4 wt %, still more preferably less than 3 wt %, yet more preferably less than 2 wt % and most preferably less than 1 wt %. In further preferred embodiments, the ionic liquids are used without any sulfur- or phosphorus-containing containing compounds as additives—for instance as corrosion inhibiting additives or for any other purpose.

As a further advantage, many of the preferred ionic liquids used in the methods of the invention can be obtained economically from widely available starting materials.

In a first aspect, the present invention provides a method of inhibiting corrosion of a metallic surface in contact with a corrosive fluid, the method comprising adding to the corrosive fluid an ionic liquid having the formula:

$$[Cat^+][X^-—Z\text{-}Bas]$$

wherein: $[Cat^+]$ represents one or more cationic species;

$[X^-—Z\text{-}Bas]$ represents one or more anionic species wherein:

$X^-$ represents an anionic moiety;

Z is a covalent bond joining $X^-$ and Bas, or a divalent linking group; and

Bas is a basic moiety, in an amount of from 1 to 5,000 ppm by weight, based on the total weight of the corrosive fluid.

Preferably, $X^-$ represents a group selected from $—CO_2^-$ and $—SO_3^-$. Most preferably, $X^-$ is $—CO_2^-$.

In some embodiments of the invention, Bas may refer to a basic moiety which is the conjugate base of an acidic moiety having a $pK_a$ of 4.0 or greater, more preferably 5.0 or greater, still more preferably, 6.0 or greater, still more preferably 7.0 or greater, yet still more preferably 8.0 or greater, yet still more preferably 9.0 or greater, and most preferably 10.0 or greater.

In further preferred embodiments of the invention, Bas refers to a basic moiety which is the conjugate base of an acidic moiety having a $pK_a$ of less than 14.0, more preferably less than 13.0 and most preferably less than 12.0.

As used herein, the $pK_a$ of the basic moiety (Bas) is assumed to be the same as the $pK_a$ of the conjugate acid of the compound $CH_3CH_2$-Bas. For instance, where Bas represents a diethylamine group, the $pK_a$ of Bas is assumed to be the same as the $pK_a$ of the conjugate acid of triethylamine ($Et_3NH^+$).

Suitably, Bas comprises at least one basic nitrogen, phosphorus, sulfur, or oxygen atom, preferably, at least one basic nitrogen atom.

In some embodiments, Bas may be selected from $—N(R^1)(R^2)$, $—P(R^1)(R^2)$, $—S(R^1)$, and $—O(R^3)$. Suitably, $R^1$, $R^2$, and $R^3$ are independently selected from linear or branched ($C_1$ to $C_8$) alkyl, ($C_1$ to $C_8$) cycloalkyl, ($C_6$ to $C_{10}$) aryl, ($C_6$ to $C_{10}$) aralkyl and ($C_6$ to $C_{10}$) substituted aryl, and $R^1$ and $R^2$ may also independently be hydrogen, or $R^1$ and $R^2$ together with the attached nitrogen or phosphorus atom form part of a heterocyclic ring.

In accordance with this embodiment of the invention, Bas is most preferably selected from $—N(R^1)(R^2)$ and $—P(R^1)(R^2)$, and is most preferably $—N(R^1)(R^2)$.

Preferably, $R^1$, $R^2$ and $R^3$ are independently selected from methyl, ethyl, n-propyl, isopropyl, n-butyl, iso-butyl, tert-butyl, n-pentyl, n-hexyl, cyclohexyl, benzyl and phenyl, or, in the case of an $—N(R^1)(R^2)$ group, $R^1$ and $R^2$ together represent a tetramethylene or pentamethylene group optionally substituted by one or more $C_{1-4}$ alkyl groups. Either of $R^1$ and $R^2$ may also be hydrogen.

In the context of the present invention, the group —OH is not considered basic due to difficulties with protonation. Accordingly, where Bas is defined as $—O(R^3)$, $R^3$ does not include hydrogen.

In further embodiments, Bas may be selected from heterocyclic rings comprising at least one basic nitrogen atom.

Examples of suitable basic heterocyclic rings include pyrrolidine, piperidine, morpholine, piperazine, imidazole, pyrazole, oxazole, isoxazole, thiazole, isothiazole, benzimidazole, benzoxazole, pyridine, pyridazine, pyrimidine, pyrazine, quinoline, and isoquinoline. Preferably, the basic heterocyclic ring is selected from pyrrolidine, piperidine, morpholine, imidazole, benzimidazole and pyridine. Particularly preferred basic heterocyclic rings are pyrrolidine and piperidine. Preferably, the basic heterocyclic rings are bonded to Z through a ring carbon atom.

In some embodiments, the basic moiety is a "hindered basic group" i.e. is a functional group that acts as a base and, owing to steric hindrance, does not chemically bond to any of the components of the oil (other of course than by accepting a proton in the usual reaction of a Brønsted acid with a Brønsted base). Suitable hindered basic groups include —$N(CH(CH_3)_2)_2$ and —$N(C(CH_3)_3)_2$. Preferably, the hindered basic group has a lower nucleophilicity (or greater steric hindrance) than $N(C_2H_5)_3$.

In preferred embodiments, the basic moiety is a non-hindered basic group. Examples of preferred non-hindered basic groups include —$NH_2$, —NHMe, —$NMe_2$, and —NHEt.

Z may be a divalent organic radical having from 1 to 18 carbon atoms, preferably 1 to 8 carbon atoms, more preferably, 2 to 6 carbon atoms. The divalent organic radical, Z, may be branched or unbranched. The divalent organic radical, Z, may be substituted or unsubstituted.

Suitably, the divalent organic radical, Z, is a divalent aliphatic radical (for example, alkylene, alkenylene, cycloalkylene, oxyalkylene, oxyalkyleneoxy, alkyleneoxyalkylene or a polyoxyalkylene) or is a divalent aromatic radical (for example, arylene, alkylenearylene or alkylenearylenealkylene).

Examples of preferred Z groups which may be used according to the invention include:

(a) divalent alkylene radicals selected from: —($CH_2$—$CH_2$)—, ($CH_2$—$CH_2$—$CH_2$)—, —($CH_2$—$CH_2$—$CH_2$—$CH_2$)—, —($CH_2$—$CH_2$—$CH_2$—$CH_2$—$CH_2$)—, —($CH_2$—$CH_2$—$CH_2$—$CH_2$—$CH_2$—$CH_2$)—, —($CH_2$—$CH(CH_3)$)—, and —($CH_2$—$CH(CH_3)$—$CH_2$—$CH(CH_3)$)—;

(b) divalent alkyleneoxyalkylene radicals selected from: —($CH_2$—$CH_2$—O—$CH_2$—$CH_2$)—, —($CH_2$—$CH_2$—O—$CH_2$—$CH_2$—$CH_2$)—, and —($CH_2$—$CH(CH_3)$—O—$CH_2$—$CH(CH_3)$)—;

(c) divalent polyoxyethylene radicals selected from: —$(CH_2CH_2O)_n$—($CH_2CH_2$)— where n is an integer in the range 1 to 9 or —$(CH_2CH(CH_3)O)_m$—($CH_2CH(CH_3)$)— where m is an integer in the range 1 to 6; and (d) divalent alkylenearylene or alkylenearylenealkylene radicals selected from: —($CH_2$—$C_6H_4$)—, and —($CH_2$—$C_6H_4$—$CH_2$)—.

Where Bas represents a basic heterocyclic ring bonded to Z through a ring carbon atom, Z may also preferably be a covalent bond.

In a further preferred embodiment, Z may have the formula —$(CH_2)_pCHR^4(CH_2)_q$—, wherein p+q is an integer of from 1 to 6, and R represents a $C_1$ to $C_6$ straight chain or branched alkyl group, which is optionally substituted by 1, 2 or 3 groups selected from $C_6$ to $C_{10}$ aryl, $C_1$ to $C_6$ alkoxy, —S($C_1$ to $C_6$ alkyl), —OH, —SH, —$N(R^1)(R^2)$, —C(O)$NH_2$, —$CO_2H$, —$CO_2^-$, imidazolyl, indolyl, and —NHC(=NH)$NH_2$, wherein said aryl and alkoxy groups may also be substituted by 1, 2 or 3 groups selected from —OH, —SH, —$N(R^1)(R^2)$, —C(O)$NH_2$, —$CO_2H$, and —$CO_2^-$, and wherein $R^1$ and $R^2$ are as defined above.

A convenient and economical group of basic anions includes the amino acid anions. As used herein, the term "amino acid anions" refers to anions of naturally occurring amino acids as well as synthetic amino acids. In the case of chiral amino acids, either enantiomer may be used, although the naturally occurring enantiomer is usually cheaper. Amino acid anions which may be used according to the present invention include alaninate, argininate, asparaginate, aspartate (as the monoanion and the dianion), cysteinate, cystinate (i,e, the disulfide linked dimer of cysteine, as the monoanion and the dianion) glutamate (as the monoanion and the dianion), glycinate, histidinate, isoleucinate, leucinate, lysinate, methioninate, phenylalaninate, prolinate, serinate, threoninate, tryptophanate, tyrosinate, valinate, and taurinate.

Preferred amino acid anions which may be used as the ionic liquid anion [$X^-$—Z-Bas] in the method of the invention include serinate, prolinate, histidinate, threoninate, valinate, asparaginate, lysinate taurinate, and cystinate. Most preferably, the amino acid anion is selected from lysinate, threoninate, serinate, taurinate and cystinate In accordance with the present invention, [$Cat^+$] may represent one or more cationic species selected from: ammonium, benzimidazolium, benzofuranium, benzothiophenium, benzotriazolium, borolium, cinnolinium, diazabicyclodecenium, diazabicyclononenium, 1,4-diazabicyclo[2.2.2]octanium, diazabicyclo-undecenium, dithiazolium, furanium, guanidinium, imidazolium, indazolium, indolinium, indolium, morpholinium, oxaborolium, oxaphospholium, oxazinium, oxazolium, iso-oxazolium, oxothiazolium, phospholium, phosphonium, phthalazinium, piperazinium, piperidinium, pyranium, pyrazinium, pyrazolium, pyridazinium, pyridinium, pyrimidinium, pyrrolidinium, pyrrolium, quinazolinium, quinolinium, iso-quinolinium, quinoxalinium, quinuclidinium, selenazolium, sulfonium, tetrazolium, thiadiazolium, iso-thiadiazolium, thiazinium, thiazolium, iso-thiazolium, thiophenium, thiuronium, triazinium, triazolium, iso-triazolium, and uronium.

In a preferred embodiment of the invention, [$Cat^+$] comprises an aromatic heterocyclic cationic species selected from: benzimidazolium, benzofuranium, benzothiophenium, benzotriazolium, cinnolinium, diazabicyclodecenium, diazabicyclononenium, diazabicyclo-undecenium, dithiazolium, imidazolium, indazolium, indolinium, indolium, oxazinium, oxazolium, iso-oxazolium, oxathiazolium, phthalazinium, pyrazinium, pyrazolium, pyridazinium, pyridinium, pyrimidinium, quinazolinium, quinolinium, iso-quinolinium, quinoxalinium, tetrazolium, thiadiazolium, iso-thiadiazolium, thiazinium, thiazolium, iso-thiazolium, triazinium, triazolium, and iso-triazolium.

More preferably, [$Cat^+$] comprises or consists of a cationic species selected from:

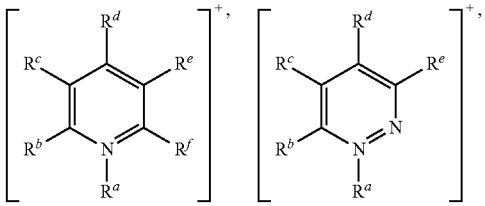

-continued

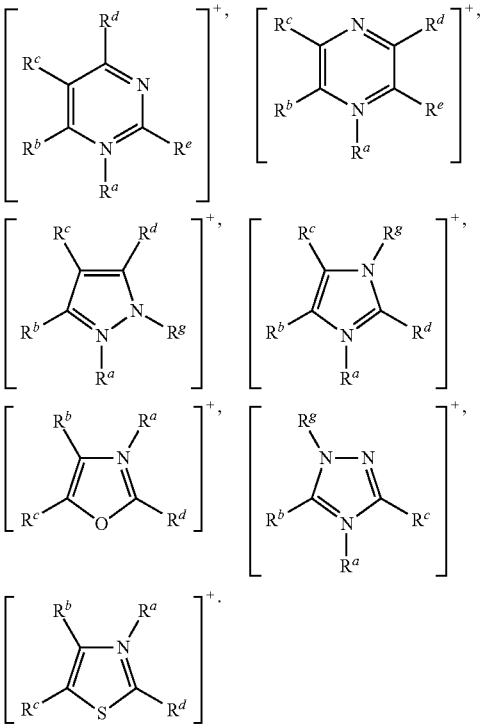

wherein: $R^a$, $R^b$, $R_c$, $R^d$, $R^e$, $R^f$ and $R^g$ are each independently selected from hydrogen, a $C_1$ to $C_m$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain —$(CH_2)_q$— wherein q is from 3 to 6; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —OC(O)$R^x$, —C(O)$R^x$, —C(O)$NR^yR^z$, —$NR^yR^z$, or a heterocyclic group, wherein $R^x$, $R^y$ and $R^z$ are independently selected from hydrogen or $C_1$ to $C_6$ alkyl.

$R^a$ is preferably selected from $C_1$ to $C_{15}$, linear or branched, alkyl, more preferably $C_2$ to $C_{10}$ linear or branched alkyl, still more preferably, $C_2$ to $C_8$ linear or branched alkyl, and most preferably $C_4$ to $C_8$ linear or branched alkyl. Further examples include wherein $R^a$ is selected from methyl, ethyl, n-propyl, n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl and n-octadecyl.

In the cations comprising an $R^g$ group, $R^g$ is preferably selected from $C_1$ to $C_{10}$ linear or branched alkyl, more preferably, $C_1$ to $C_5$ linear or branched alkyl, and most preferably $R^g$ is a methyl group.

In the cations comprising both a $R^a$ and an $R^g$ group, $R^a$ and $R^g$ are each preferably independently selected from $C_1$ to $C_{20}$, linear or branched, alkyl, and one of $R^a$ and $R^g$ may also be hydrogen. More preferably, one of $R^a$ and $R^g$ may be selected from $C_2$ to $C_{10}$ linear or branched alkyl, still more preferably, $C_2$ to $C_8$ linear or branched alkyl, and most preferably $C_4$ to $C_8$ linear or branched alkyl, and the other one of $R^a$ and $R^g$ may be selected from $C_1$ to $C_{10}$ linear or branched alkyl, more preferably, $C_1$ to $C_5$ linear or branched alkyl, and most preferably a methyl group. In a further preferred embodiment, $R^a$ and $R^g$ may each be independently selected, where present, from $C_1$ to $C_{20}$ linear or branched alkyl and $C_1$ to $C_{15}$ alkoxyalkyl.

In a further preferred embodiment, one of $R^a$ and $R^g$ may be substituted with hydroxy, methoxy or ethoxy.

In further preferred embodiments, $R^b$, $R^c$, $R^d$, $R^e$, and $R^f$ are independently selected from hydrogen and $C_1$ to $C_5$ linear or branched alkyl, and more preferably $R^b$, $R^c$, $R^d$, $R^e$, and $R^f$ are each hydrogen.

In this embodiment of the invention, [$Cat^+$] preferably comprises or consists of a cationic species selected from:

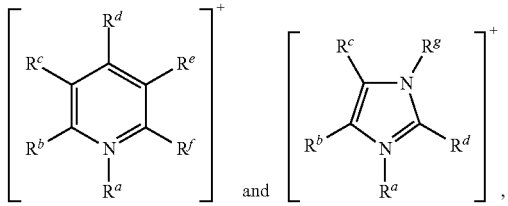

wherein: $R^a$, $R^b$, $R^c$, $R^d$, $R^e$, $R^f$, and $R^g$ are as defined above.

Still more preferably, [$Cat^+$] preferably comprises or consists of a cationic species selected from:

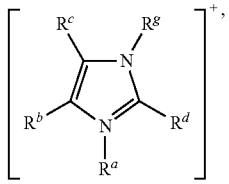

wherein: $R^a$, $R^b$, $R^c$, $R^d$, $R^e$, $R^f$, and $R^g$ are as defined above.

Preferably, [$Cat^+$] comprises or consists of a cationic species selected from:

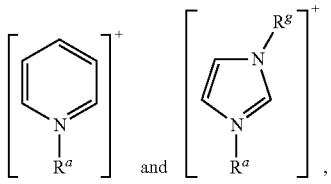

wherein: $R^a$ and $R^g$ are as defined above.

Specific examples of preferred nitrogen-containing aromatic heterocyclic cations that may be used according to the present invention include:

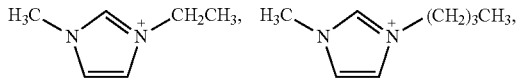

[emim] [bmim]

-continued

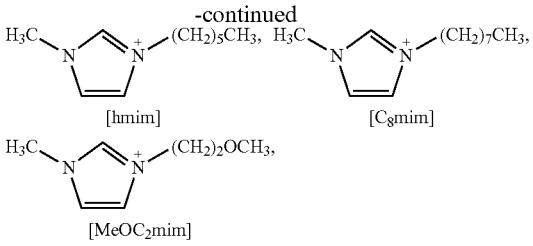

[hmim] [$C_8$mim] [$MeOC_2$mim]

In another preferred embodiment of the invention, [Cat$^+$] comprises a saturated heterocyclic cation selected from cyclic ammonium, 1,4-diazabicyclo[2.2.2]octanium, morpholinium, cyclic phosphonium, piperazinium, piperidinium, quinuclidinium, and cyclic sulfonium.

More preferably, [Cat$^+$] comprises or consists of a cation selected from:

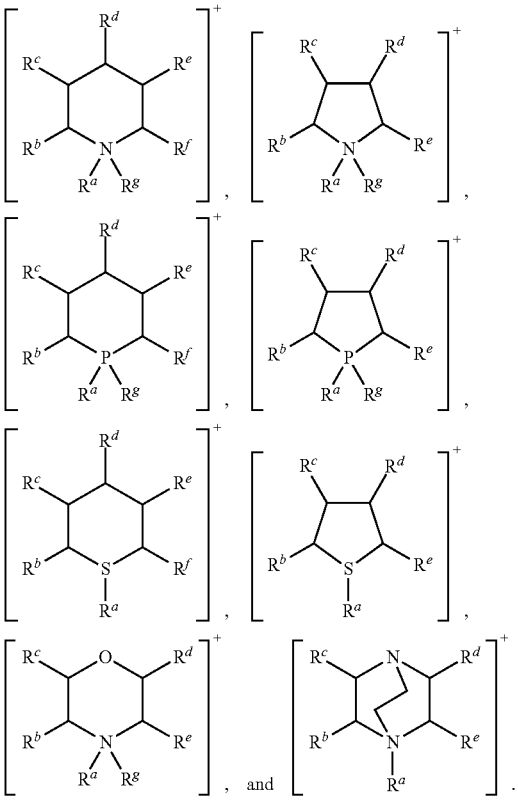

wherein: $R^a$, $R^b$, $R^c$, $R^d$, $R^e$, $R^f$, and $R^g$ are as defined above.

In another preferred embodiment of the invention, [Cat$^+$] comprises or consists of an acyclic cation selected from:

$[N(R^a)(R^b)(R^c)(R^d)]^+$, $[P(R^a)(R^b)(R^c)(R^d)]^+$, and $[S(R^a)(R^b)(R^c)]^+$, wherein: $R^a$, $R^b$, $R^c$, $R^d$ are each independently selected from a $C_1$ to $C_{20}$, straight chain or branched alkyl group, a $C_3$ to $C_8$ cycloalkyl group, or a $C_6$ to $C_{10}$ aryl group; and wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —OC(O)$R^x$, —C(O)$R^x$, —C(O)$NR^yR^z$, —$NR^yR^z$, or a heterocyclic group, wherein $R^x$, $R^y$ and $R^z$ are independently selected from hydrogen or $C_1$ to $C_6$ alkyl; and wherein one or more of $R^a$, $R^b$, $R^c$, $R^d$ may be hydrogen.

More preferably, [Cat$^+$] comprises or consists of a cationic species selected from:

$[N(R^a)(R^b)(R^c)(R^d)]^+$, $[P(R^a)(R^b)(R^c)(R^d)]^+$, wherein: $R^a$, $R^b$, $R^c$, $R^d$ are as defined above.

In the acyclic cations defined above, $R^a$ is preferably selected from $C_1$ to $C_m$, linear or branched, alkyl, more preferably $C_2$ to $C_{16}$ linear or branched alkyl, and most preferably $C_4$ to $C_{14}$ linear or branched alkyl. Further examples include wherein $R^a$ is selected from methyl, ethyl, n-propyl, n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl and n-octadecyl.

In the acyclic cations defined above, $R^b$, $R^c$ and $R^d$ are preferably independently selected from $C_1$ to $C_{10}$ linear or branched alkyl, more preferably, $C_1$ to $C_5$ linear or branched alkyl. $R^d$ is preferably selected from $C_1$ to $C_{10}$ linear or branched alkyl, more preferably, $C_1$ to $C_5$ linear or branched alkyl, and hydrogen.

Preferably two of $R^b$, $R^c$ and $R^d$, and more preferably each of $R^b$, $R^c$ and $R^d$, are selected from methyl, ethyl, n-propyl, n-butyl, n-pentyl and n-hexyl.

Still more preferably, two of $R^b$, $R^c$ and $R^d$, and more preferably each of $R^b$, $R^c$ and $R^d$, are n-butyl or n-hexyl.

In a further preferred embodiment, one of $R^a$, $R^b$, $R^c$ and $R^d$ may be substituted with hydroxy, methoxy or ethoxy.

Preferably, no more than two of $R^a$, $R^b$, $R^c$ and $R^d$ are hydrogen. More preferably no more than one of $R^a$, $R^b$, $R^c$ and $R^d$ is hydrogen.

Specific examples of preferred acyclic ammonium and phosphonium cations suitable for use according to the present invention include:

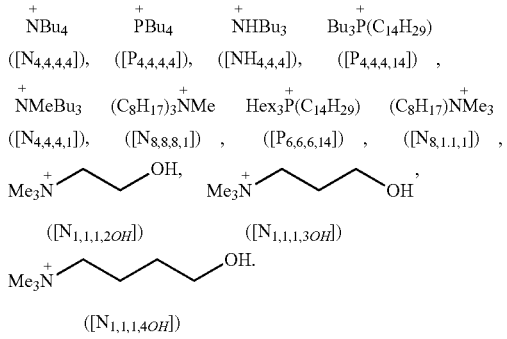

In a further embodiment of the invention, [Cat$^+$] comprises a cation selected from guanidinium, cyclic guanidinium, uronium, cyclic uronium, thiuronium and cyclic thiuronium.

More preferably, [Cat$^+$] comprises a cation having the formula:

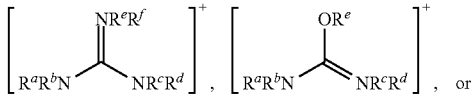

-continued

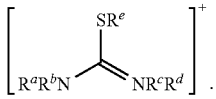

wherein: $R^a$, $R^b$, $R^c$, $R^d$, $R^e$, and $R^f$ are each independently selected from a $C_1$ to $C_{20}$, straight chain or branched alkyl group, a $C_3$ to $C_8$ cycloalkyl group, or a $C_6$ to $C_{10}$ aryl group, or any two of $R^a$, $R^b$, $R^c$, $R^d$, attached to different nitrogen atoms form a methylene chain —$(CH_2)_q$— wherein q is from 2 to 5; wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —$OC(O)R^x$, —$C(O)R^x$, —$C(O)NR^yR^z$, —$NR^yR^z$, or a heterocyclic group, wherein $R^x$, $R^y$ and $R^z$ are independently selected from hydrogen or $C_1$ to $C_6$ alkyl.

Specific examples of guanidinium, uronium, and thiuronium cations suitable for use according to the present invention include:

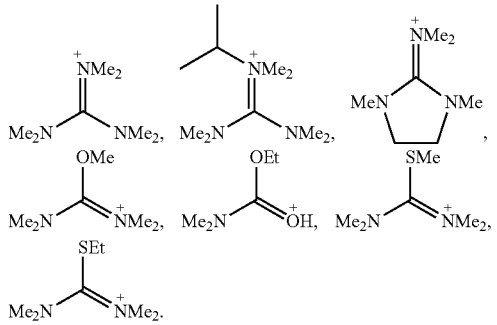

In further embodiments of the invention, the [$Cat^+$] may comprise or consist of a basic cation having the formula:

[$Cat^+$-Z-Bas]

wherein: $Cat^+$ represents a positively charged moiety, and Z and Bas are as defined above.

The $Cat^+$ moiety in [$Cat^+$-Z-Bas] may comprise a heterocyclic ring structure selected from: ammonium, benzimidazolium, benzofuranium, benzothiophenium, benzotriazolium, borolium, cinnolinium, diazabicyclodecenium, diazabicyclononenium, 1,4-diazabicyclo[2.2.2]octanium, diazabicyclo-undecenium, dithiazolium, furanium, guanidinium, imidazolium, indazolium, indolinium, indolium, morpholinium, oxaborolium, oxaphospholium, oxazinium, oxazolium, iso-oxazolium, oxothiazolium, phospholium, phosphonium, phthalazinium, piperazinium, piperidinium, pyranium, pyrazinium, pyrazolium, pyridazinium, pyridinium, pyrimidinium, pyrrolidinium, pyrrolium, quinazolinium, quinolinium, iso-quinolinium, quinoxalinium, quinuclidinium, selenazolium, sulfonium, tetrazolium, thiadiazolium, iso-thiadiazolium, thiazinium, thiazolium, iso-thiazolium, thiophenium, thiuronium, triazinium, triazolium, iso-triazolium, and uronium. Examples of preferred [$Cat^+$-Z-Bas] where $Cat^+$ is a heterocyclic ring structure include:

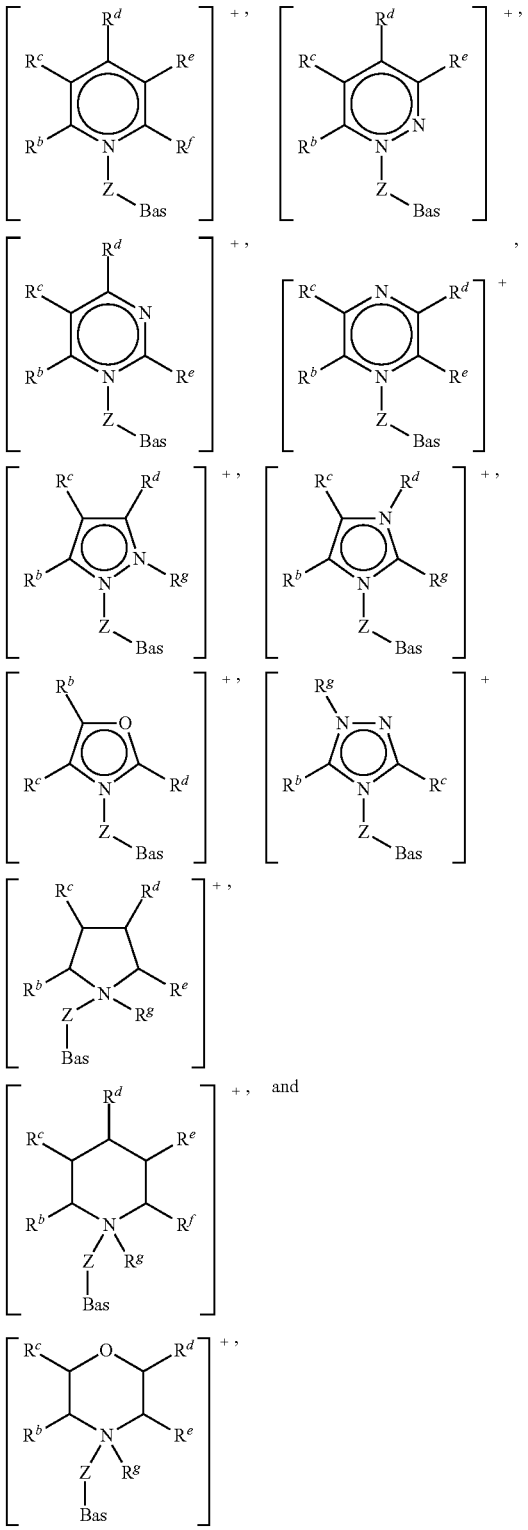

wherein: Bas and Z are as defined above; and $R^b$, $R^c$, $R^d$, $R^e$, $R^f$ and $R^g$ are independently selected from hydrogen, a $C_1$ to $C_{20}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain —$(CH_2)_q$— wherein q is from 3 to 6; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —$OC(O)R^x$, —$C(O)R^x$, —$C(O)NR^yR^z$, —$NR^yR^z$, or a heterocyclic group, wherein $R^x$, $R^y$ and $R^z$ are independently selected from hydrogen or $C_1$ to $C_6$ alkyl.

Preferred $Cat^+$-Z-Bas, where $Cat^+$ is a heterocyclic ring structure, includes:

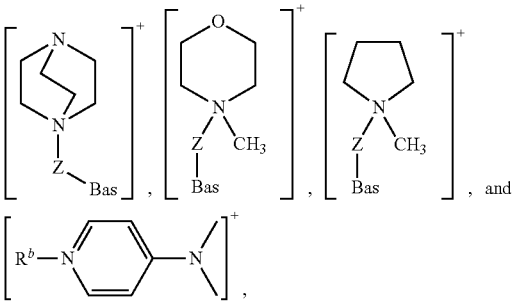

wherein: Bas, Z and $R^b$ are as defined above.

It is also envisaged that the $Cat^+$ moiety may be an acyclic moiety. Preferably, the acyclic moiety comprises a group selected from acyclic ammonium, acyclic phosphonium, and acyclic guanidinium, Where the $Cat^+$ moiety is an acyclic moiety, [$Cat^+$-Z-Bas] is preferably selected from:

$$[N(Z\text{-}Bas)(R^b)(R^c)(R^d)]^+ \text{and } [P(Z\text{-}Bas)(R^b)(R^c)(R^d)]^+$$

wherein: Bas and Z are as defined above, and $R^b$, $R^c$, $R^d$ are independently selected from a $C_1$ to $C_{20}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain —$(CH_2)_q$— wherein q is from 3 to 6; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —$OC(O)R^x$, —$C(O)R^x$, —$C(O)NR^yR^z$, —$NR^yR^z$, or a heterocyclic group, wherein $R^x$, $R^y$ and $R^z$ are independently selected from hydrogen or $C_1$ to $C_6$ alkyl; and wherein one or more of $R^b$, $R^c$, $R^d$ may be hydrogen.

Preferably, $R^b$, $R^c$ and $R^d$ are as defined above for the cations $[N(R^a)(R^b)(R^c)(R^d)]$ and $[P(R^a)(R^b)(R^c)(R^d)]$.

Preferably, no more than two of $R^b$, $R^c$ and $R^d$ are hydrogen. More preferably, no more than one of $R^b$, $R^c$ and $R^d$ is hydrogen.

Examples of preferred [$Cat^+$-Z-Bas] of this class include:

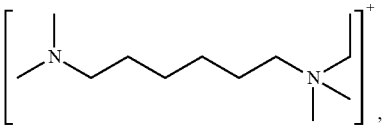

-continued

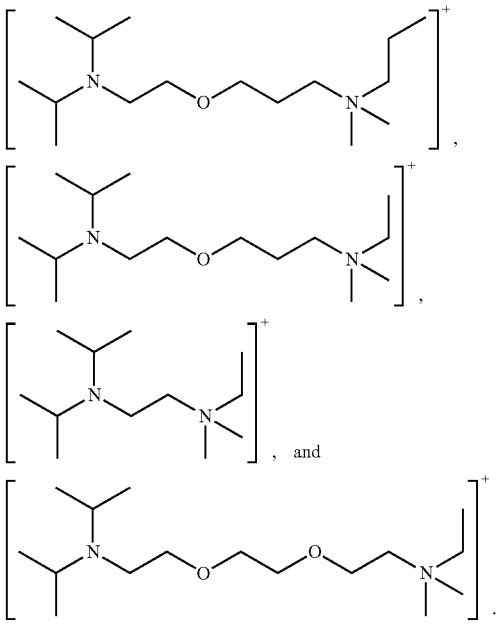

It will be appreciated that the present invention is not limited to ionic liquids comprising a single cation and a single anion. Thus, [$Cat^+$] may, in certain embodiments, represent two or more cations, such as a statistical mixture of 1,3-dimethylimidazolium, 1-ethyl-3-methylimidazolium and 1-3-diethylimidazolium. Similarly, [$X^+$—Z-Bas] may, in certain embodiments, represent two or more anions, such as a mixture of lysinate and threoninate anions.

The organic cations [$Cat^+$] and anions [$X^-$—Z-Bas] defined above are generally single charged ions. However, in accordance with the present invention, it is not excluded that [$Cat^+$] and/or [$X^-$] may represent ions having a multiple charge, for instance the dianions of aspartic acid and glutamic acid, as well as the dianions of amino acid dimers, such as cystine. The relative amounts of [$Cat^+$] and [$X^-$—Z-Bas] in the ionic liquids defined above are therefore not fixed, but may take a range of values provided that there is overall charge balance.

The basic ionic liquid used in the method of the present invention preferably has a melting point of less than 150° C., more preferably less than 100° C., still more preferably less than 80° C., still more preferably less than 50° C. and most preferably less than 30° C. Preferably, the ionic liquid is liquid at the operating temperature of the method of the invention. Thus, when the method of the present invention is carried out at high temperature, such as in a distillation apparatus, the ionic liquid may have a higher melting point.

In accordance with some embodiments of the present invention, the corrosive fluid is preferably an acid-containing fluid. More preferably, the acid-containing fluid is an acid-containing hydrocarbon fluid or an acid-containing aqueous fluid. Most preferably, the corrosive fluid is an acid-containing hydrocarbon fluid.

As used herein, the term "hydrocarbon fluid" refers to a liquid mixture comprising predominantly hydrocarbons, for instance at least 70 wt % hydrocarbons, more preferably at least 80 wt % hydrocarbons, still more preferably at least 90 wt % hydrocarbons and most preferably at least 95 wt % hydrocarbons. The hydrocarbon fluid is preferably a crude oil or a crude oil derivative, where the term "crude oil"

derivative is intended to encompass all liquid hydrocarbon process streams from a crude oil refining operation. Naphthenic acids in particular tend to accumulate in higher boiling fractions of crude oil. Accordingly, in preferred embodiments of the invention, the hydrocarbon fluid has a boiling range of between 100 and 450° C., more preferably between 150 and 450° C. and most preferably between 200 and 450° C.

Examples of acidic hydrocarbon fluids which may be treated according to the method of the present invention include fuel oil, kerosene, diesel, liquid petroleum gas, gasoline, naphtha and natural gas condensates. As used herein, the term "crude oil" derivative is intended to encompass crude oils following preliminary processing steps (for example dehydration, desulfurization, and/or mercury removal)

In accordance with the present invention, the hydrocarbon fluid preferably has a TAN value of at 0.5 or greater, for instance 1.0 or greater, 1.5 or greater, 2.0 or greater or 2.5 or greater. In some embodiments of the invention, the hydrocarbon fluid may have a TAN value of at least 3.0 or greater, for instance at least 4.0 or greater or at least 5.0 or greater.

Preferably, the acids in the hydrocarbon fluid comprise or consist of naphthenic acids and/or sulfur-containing acids. Most preferably, the acids in the hydrocarbon fluid comprise or consist of naphthenic acids.

As used herein, the term "acid-containing aqueous fluid" preferably refers to aqueous acids containing acidic hydrogen atoms in a concentration of at least 0.01 M, more preferably at least 0.05 M, more preferably at least 0.1 M, still more preferably at least 0.5 M, still more preferably at least 1.0 M and most preferably at least 2.0 M. The term "acidic hydrogen atoms" as used herein refers to acids having a $pK_a$ of less than 14, more preferably less than 12.0, still more preferably less than 10.0 and most preferably less than 8.0. In some embodiments, the term "acidic hydrogen atoms" may refer to acids which are highly dissociated in solution, for instance having a $pK_a$ of less than 5.0, more preferably less than 3.0 and most preferably less than 1.0.

As used herein, the term "acid-containing aqueous fluid" refers to aqueous fluids having a pH of less than 7.0. In preferred embodiments, the aqueous fluid may have a pH of less than 6.0, less than 5.0, less than 4.0, less than 3.0, less than 2.0 or less than 1.0. The acids in the acid-containing aqueous fluid may include mineral acids, such as HCl, HBr, HI, $H_2SO_4$, $H_3PO_4$, and $HNO_3$. Alternatively, or in addition, the acid-containing aqueous fluid may include organic acids, such as formic acid, acetic acid, citric acid, and phenol.

In further preferred embodiments of the invention, the corrosive fluid may be an aqueous solution of at least one salt. In principle, this aspect of the invention encompasses any water-soluble salt.

In preferred embodiments, the salt has a cation selected from metal cations and $NH_4^+$, and combinations thereof. Preferably, the metal cation is selected from salts of Li, Na, K, Mg, Ca and combinations thereof. More preferably, the salt has a cation selected from $[Li]^+$, $[Na]^+$, $[K]^+$, $[Mg]^{2+}$, and $[Ca]^{2+}$, and $[NH_4]^+$, and combinations thereof. Most preferably the salt has a cation selected from $[Na]^+$, $[K]^+$ and $[NH_4]^+$, and combinations thereof.

In preferred embodiments, the salt comprises an anion selected from a) a halide anion selected from: $[F]^-$, $[Cl]^-$, $[Br]^-$, $[I]^-$;

b) a pseudohalide anion selected from: $[N_3]^-$, $[NCS]^-$, $[NCSe]^-$, $[NCO]^-$, $[CN]^-$;

c) a sulphate anion selected from: $[HSO_4]^-$, $[SO_4]^{2-}$, $[R^2OSO_2O]^-$, d) a sulphite anion selected from: $[HSO_3]^-$, $[SO_3]^{2-}$, $[R^2OSO_2]^-$;

e) a sulfonate anion selected from: $[R^1SO_2O]^-$;

f) a sulfonimide anion selected from: $[(R^1SO_2)_2N]^-$, g) a phosphate anion selected from: $[H_2PO_4]^-$, $[HPO_4]^{2-}$, $[PO_4]^{3-}$, $[R^2OPO_3]^{2-}$, $[(R^2O)_2PO_2]^-$, h) a phosphite anion selected from: $[H_2PO_3]^-$, $[HPO_3]^{2-}$, $[R^2OPO_2]^{2-}$, $[(R^2O)_2PO]^-$, i) a phosphonate anion selected from: $[R^1PO_3]^{2-}$, $[R^1P(O)(OR^2)O]^-$, j) a carboxylate anion selected from: $[R^2CO_2]^-$; and k) a nitrate ($[NO_3]^-$) or nitrite ($[NO_2]^-$) anion;

wherein $R^1$ and $R^2$ independently represent a hydrocarbyl group containing from 1 to 20 carbon atoms, for instance an alkyl, alkenyl, alkynyl or aryl group.

More preferably, the salt comprises an anion selected from $[F]^-$, $[Cl]^-$, $[Br]^-$, $[I]^-$, $[NO_3]^-$, $[NO_2]^-$, $[H_2PO_4]^-$, $[HPO_4]^{2-}$, $[PO_4]^{3-}$, $[MeOPO_3]^{2-}$, $[EtOPO_3]^{2-}$, $[(MeO)_2PO_2]^-$, $[(EtO)_2PO_2]^-$, $[MePO_3]^{2-}$, $[EtPO_3]^{2-}$, $[HCO_2]^-$, $[MeCO_2]^-$, $[EtCO_2]^-$, $[CH_2(OH)CO_2]^-$, $[CH_3CH(OH)CH_2CO_2]^-$, $[PhCO_2]^-$, $[SO_4]^{2-}$, $[HSO_4]^-$, $[MeOSO_2O]^-$, $[EtOSO_2O]^-$, $[MeSO_2O]^-$, $[PhSO_2O]^-$, $[4\text{-}MeC_6H_4SO_2O]^-$, $[BF_4]$, and $[PF_6]^-$.

Most preferably, the salt comprises an anion selected from $[F]^-$, $[Cl]^-$, $[Br]^-$, $[I]^-$, $[NO_3]^-$, and $[SO_4]^{2-}$.

Examples of salts which may be present in the salt solution include LiCl, LiBr, LiI, $Li_2SO_4$, NaCl, NaBr, NaI, $Na_2SO_4$, KCl, KBr, KI, $K_2SO_4$, $NH_4Cl$, $NH_4Br$, $NH_4I$, and $(NH_4)_2SO_4$.

In accordance with this embodiment of the invention, the corrosive fluid is most preferably an aqueous solution of NaCl, such as a brine.

The concentration of the salt is dependent on the solubility of the salt compound in water. However, in general, the aqueous solution may comprise from 0.01 to 20 wt % of the salt, for instance from 0.1 to 10 wt % of the salt, more preferably from 1 to 5 wt % of the salt.

The basic ionic liquid is preferably added to the corrosive fluid in an amount of from 10 to 2,000 ppm by weight, still more preferably 10 to 1,000 ppm by weight, still more preferably 10 to 500 ppm by weight, and most preferably 20 to 200 ppm by weight based on the total weight of the corrosive fluid.

In a further preferred embodiment, where the corrosive fluid is an acid-containing hydrocarbon fluid, the amount of basic ionic liquid added to the acid-containing hydrocarbon fluid may be in the range of from 10 n to 1,000 n ppm by weight based on the total weight of the ionic liquid, where n represents the TAN value of the hydrocarbon fluid. More preferably the amount of basic ionic liquid added to the acid-containing hydrocarbon fluid is in the range of from 10 n to 400 n ppm by weight, still more preferably in the range of from 10 n to 200 n ppm by weight, still more preferably in the range of from 10 n to 100 n ppm by weight, and most preferably 20 n to 50 n ppm by weight, based on the total weight of the acid-containing hydrocarbon fluid.

The term "metallic surface" may refer to any metallic surface which comes into contact with a corrosive fluid during processing, transportation or storage of the corrosive fluid. More preferably, the term "metallic surface" refers to a surface of metallic processing apparatus. In preferred embodiments, the term "metallic surface" refers to a metallic surface of a reactor vessel or a distillation vessel, for example as used in the processing and refining of crude oil and crude oil derivatives/distillates.

The metallic surface is preferably an iron or iron alloy surface. Most preferably, the metallic surface is a steel surface, such as carbon steel or low-alloy steel. As discussed above, the method of the invention aims to provide an alternative to the use of costly stainless steel, however it is not excluded that the metallic surface may be a stainless steel surface.

In accordance with the method of the invention, the acid-containing hydrocarbon fluid preferably contacts the metallic surface at a temperature in the range of from 0 to 450° C. The method of the invention is particularly useful at elevated temperatures where acid-induced corrosion rates are usually higher. Thus, in a preferred embodiment of the invention, the acid-containing hydrocarbon fluid contacts the metallic surface at a temperature in the range of from 50 to 450° C., still more preferably in the range of from 100 to 450° C., still more preferably in the range of from 150 to 450° C., and most preferably in the range of from 200 to 450° C.

In the case of corrosive aqueous fluids (i.e. acid-containing aqueous fluid or aqueous salt solutions) the corrosive aqueous fluid may contact the metallic surface at a temperature across the full liquid range of the corrosive aqueous fluid, i.e. substantially in the range of from 0 to 100° C., more preferably from 50 to 100° C.

In the case of acid-containing hydrocarbon fluids, the method of the invention provides the further advantage that the lifespan of catalysts used in hydrotreaters and hydrocracking units may be increased since the concentration of iron corroded from equipment surfaces (a catalyst poison) in the acid-containing hydrocarbon fluid is reduced.

In another aspect, the present invention provides a method of inhibiting corrosion of a metallic surface in contact with a corrosive fluid, the method comprising forming a dopant layer of an ionic liquid having the formula:

$$[Cat^+][X^-—Z\text{-}Bas]$$

wherein: $[Cat^+]$ and $[X^-—Z\text{-}Bas]$ are as defined above, on the metallic surface prior to contacting the metallic surface with the corrosive fluid.

Thus, in addition to the use of an ionic liquid as an additive to a corrosive fluid as described above, the present invention also provides a method of inhibiting corrosion in which an ionic liquid may be used to pretreat a metallic surface prior to contacting the metallic surface with a corrosive fluid. Without being bound by any particular theory, it is believed that the ionic liquid forms a dopant layer on the metallic surface which passivates the metallic surface towards corrosive fluids.

In accordance with this aspect of the invention, the corrosive fluid may be any of the corrosive fluids described above. Thus, the corrosive fluid is preferably an acid-containing fluid as described above. More preferably, the acid-containing fluid is an acid-containing hydrocarbon fluid or an acid-containing aqueous fluid. Most preferably, the corrosive fluid is an acid-containing hydrocarbon fluid.

Alternatively, the corrosive fluid may be an aqueous solution of at least one salt as described above.

In accordance with this aspect of the invention, the metallic surface is preferably contacted with a solution of the ionic liquid, and the solvent is subsequently removed so as to leave a dopant layer of ionic liquid on the metallic surface. Preferably, the solvent is a volatile organic solvent, such as methanol, ethanol, acetone, ethyl acetate or acetonitrile. In accordance with this embodiment of the invention, the ionic liquid is preferably present in the ionic liquid solution in an amount of from 10 to 5,000 ppm by weight, based on the total weight of the solution.

The metallic surface is preferably contacted with the ionic liquid or ionic liquid solution for a period of from 1 minute to 24 hours, more preferably from 10 minutes to 12 hours, still more preferably from 30 minutes to 6 hours, and most preferably from 1 hour to 3 hours.

The metallic surface is preferably contacted with the ionic liquid or ionic liquid solution at ambient temperature (i.e. ca. 20° C.) and atmospheric pressure, but it is not excluded the elevated temperatures and/or pressures could be used in certain circumstances.

In accordance with this aspect of the invention, the acid-containing hydrocarbon fluid preferably contacts the metallic surface at a temperature in the range of from 0 to 450° C., more preferably from 50 to 450° C., still more preferably in the range of from 100 to 450° C., still more preferably in the range of from 150 to 450° C., and most preferably in the range of from 200 to 450° C.

In the case of corrosive aqueous fluids (i.e. acid-containing aqueous fluid or aqueous salt solutions) the corrosive aqueous fluid may contact the metallic surface at a temperature across the full liquid range of the corrosive aqueous fluid, i.e. substantially in the range of from 0 to 100° C., more preferably from 50 to 100° C.

In another aspect, the present invention provides a method of distilling an acid-containing hydrocarbon fluid feed using a distillation apparatus having a metallic surface in contact with the acid-containing hydrocarbon fluid, the method comprising adding a basic ionic liquid having the formula $[Cat^+][X^-—Z\text{-}Bas]$ to the hydrocarbon fluid feed, wherein $[Cat^+]$ and $[X^-—Z\text{-}Bas]$ are as defined above.

Preferably, the acid-containing hydrocarbon fluid feed is distilled at a temperature in the range of from 0 to 450° C., more preferably in the range of from 50 to 450° C., still more preferably in the range of from 100 to 450° C., still more preferably in the range of from 150 to 450° C., and most preferably in the range of from 200 to 450° C.

In accordance with this aspect of the invention, the acid-containing hydrocarbon fluid feed preferably comprises a hydrocarbon fluid as defined above. Most preferably, the hydrocarbon fluid comprises or consists of crude oil or a crude oil derivative. The acid-containing hydrocarbon fluid feed preferably has a TAN value of at 0.5 or greater, for instance 1.0 or greater, 1.5 or greater, 2.0 or greater or 2.5 or greater. In some embodiments of the invention, the acid-containing hydrocarbon fluid may have a TAN value of at least 3.0 or greater, for instance at least 4.0 or greater or at least 5.0 or greater.

The metallic surface of the distillation apparatus is preferably an iron or iron alloy surface. Most preferably, the metallic surface is a steel surface, such as carbon steel or low-alloy steel. As discussed above, the method of the invention aims to provide an alternative to the use of costly stainless steel, however it is not excluded that the metallic surface may be a stainless steel surface.

In a further aspect, the present invention provides the use of a basic ionic liquid as defined above to prevent or inhibit corrosion of a metallic surface in contact with a corrosive fluid. In accordance with this aspect of the invention, the metallic surface and/or the corrosive fluid are preferably as defined above.

In accordance with this aspect of the invention, the basic ionic liquid is preferably added to the corrosive fluid in an amount of from 1 to 5,000 ppm by weight, based on the total weight of the acid-containing fluid. More preferably, the basic ionic liquid is added to the corrosive fluid in an amount of from 10 to 2,000 ppm by weight, still more preferably 10 to 1,000 ppm by weight, still more preferably 10 to 500 ppm by weight, and most preferably 20 to 200 ppm by weight based on the total weight of the corrosive fluid.

EXAMPLES

Example 1

Corrosion Inhibition in Naphthenic Acids with a Range of Ionic Liquids

Mild steel coupons (~0.500 g) were degreased in absolute ethanol, dried in acetone, weighed, and stored under moisture-free conditions prior to use. To an autoclave containing a mixture of pure naphthenic acids (~10.000 g) and 1.0 wt % (10,000 ppm wt.) of the ionic liquid was added a weighed mild steel coupon. The mixture was heated under a nitrogen atmosphere for 24 h at 250° C. After cooling, the coupon was carefully removed from the naphthenic acid/ionic liquid mixture, gently washed with toluene followed by acetone to remove any organics. After drying, the coupon was gently washed with 0.01 M HCl solution to remove any external corrosion. The coupon was then washed with distilled water followed by acetone and dried overnight at 80° C.

Results for the ionic liquids triethylmethylammonium serinate ($[N_{1,2,2,2}][Ser]$), tributylmethylammonium threoninate ($[N_{1,4,4,4}][Thr]$), tetrabutylphosphonium serinate ($[P_{4,4,4,4}][Ser]$), tetrabutylphosphonium taurinate ($[P_{4,4,4,4}][Tau]$), and tributylmethylammonium lysinate ($[N_{1,4,4,4}][Lys]$), as well as for a control using no ionic liquid are shown in Table 1. The quoted % weight loss figures represent an average over three runs.

TABLE 1

| Ionic Liquid | % weight loss |
|---|---|
| none | 83 |
| $[N_{1,4,4,4}][Lys]$ | 25 |
| $[N_{1,2,2,2}][Ser]$ | 41 |
| $[N_{1,4,4,4}][Thr]$ | 45 |
| $[P_{4,4,4,4}][Ser]$ | 43 |
| $[P_{4,4,4,4}][Tau]$ | 54 |

Example 2

Corrosion Inhibition in Naphthenic Acids with Various Masses of Ionic Liquid The test described in Example 1 was repeated using varying amounts of the ionic liquid tributylmethylammonium lysinate ($[N_{1,4,4,4}][Lys]$). The results in Table 2 show that the corrosion inhibition is maintained at substantially the same level, even when the concentration of the ionic liquid is reduced by a factor of 10 from those used in Example 1.

TABLE 2

| Ionic Liquid | % weight loss |
|---|---|
| $[N_{1,4,4,4}][Lys]$ (1000 ppm wt) | 27 |
| $[N_{1,4,4,4}][Lys]$ (2000 ppm wt) | 28 |
| $[N_{1,4,4,4}][Lys]$ (6000 ppm wt) | 27 |

Example 3

Corrosion Inhibition in Naphthenic Acids by Surface Passivation

A freshly cut mild steel coupon (~0.500 g) was degreased in absolute ethanol, dried in acetone, weighed, and immersed in 1 mL of a 0.01M solution of $[N_{1,4,4,4}][Lys]$ in ethyl acetate for two hours. The coupon was then removed from the ionic liquid solution and dried in an oven at 140° C. for two hours. The ionic liquid doped coupon thus obtained was added to a glass-lined reactor containing pure naphthenic acids (~10.000 g) and stirred at ambient temperature and atmospheric pressure for 24 hours. The coupon was carefully removed from the acid mixture and gently washed with deionised water followed by 0.01 M HCl solution to remove any external corrosion. The coupon was then washed with distilled water followed by acetone and dried overnight at 80° C. Results averaged over three runs are shown in Table 3.

TABLE 3

| Ionic Liquid | % weight loss |
|---|---|
| none | 83 |
| $[N_{1,4,4,4}][Lys]$ | 9 |

Example 4

Corrosion Inhibition in Aqueous Sulphuric Acid

A freshly cut mild steel coupon (~0.500 g) was degreased in absolute ethanol, dried in acetone, weighed, and immersed in 1 mL of a 0.01M solution of $[N_{1,4,4,4}][Lys]$ in ethyl acetate for two hours.

To an autoclave containing a mixture of 2M aqueous $H_2SO_4$ (~10.000 g) and 0.02 wt % (200 ppm wt.) of methyltributylammonium cystinate ($[N_{1,4,4,4}]_2[Cys]$) was added a weighed mild steel coupon. The mixture was heated under a nitrogen atmosphere for 24 h at 250° C. After cooling, the coupon was carefully removed from the sulphuric acid/ionic liquid mixture, and gently washed with deionised water followed by 0.01 M HCl solution to remove any external corrosion. The coupon was then washed with distilled water followed by acetone and dried overnight at 80° C. Results as an average over three runs are shown in Table 4.

TABLE 4

| Ionic Liquid | % weight loss |
|---|---|
| none | 64 |
| $[N_{1,4,4,4}]_2[Cys]$ | 53 |

Example 5

Corrosion Inhibition in Aqueous Sulphuric Acid by Surface Passivation

A freshly cut mild steel coupon (~0.500 g) was degreased in absolute ethanol, dried in acetone, weighed, and immersed in 1 mL of a 0.01 M solution of $[_{6,6,6,14}]_2[Cys]$ in ethyl acetate for two hours. The coupon was then removed from the ionic liquid solution and dried in an oven at 140°

C. for two hours. The ionic liquid doped coupon thus obtained was added to a glass-lined reactor containing a 2M aqueous solution of $H_2SO_4$ (~10.000 g) and stirred at ambient temperature and atmospheric pressure for 24 hours. The coupon was carefully removed from the acid mixture and gently washed with deionised water followed by 0.01 M HCl solution to remove any external corrosion. The coupon was then washed with distilled water followed by acetone and dried overnight at 80° C.

The same experiment was repeated using $[N_{1,4,4,4}]_2$[Cys] instead of $[P_{6,6,6,14}]_2$[Cys].

Control experiments were also carried out in which degreased, dried and weighed mild steel coupons were (a) added directly to the $H_2SO_4$ solution; and (b) immersed in ethyl acetate containing no ionic liquid for two hours and dried as above, prior to being added to the $H_2SO_4$ solution.

TABLE 5

| Ionic Liquid | % weight loss |
|---|---|
| None | 64 |
| None* | 62 |
| $[P_{6,6,6,14}]_2$[Cys] | 17 |
| $[N_{1,4,4,4}]_2$[Cys] | 22 |

*Mild steel coupon immersed in solvent containing no IL

Example 6

Corrosion Inhibition in Aqueous Acetic Acid

A freshly cut mild steel coupon (~0.500 g) was degreased in absolute ethanol, dried in acetone, weighed, and immersed in 1 mL of a 0.01M solution of $[N_{1,4,4,4}]$[Lys] in ethyl acetate for two hours.

To an autoclave containing a mixture of 5M aqueous acetic acid (~10.000 g) and 0.02 wt % (200 ppm wt.) of $[N_{1,4,4,4}]_2$ was added a weighed mild steel coupon. The mixture was heated under a nitrogen atmosphere for 24 h at 250° C. After cooling, the coupon was carefully removed from the acetic acid/ionic liquid mixture, and gently washed with deionised water followed by 0.01 M HCl solution to remove any external corrosion. The coupon was then washed with distilled water followed by acetone and dried overnight at 80° C. Results as an average over three runs are shown in Table 6.

TABLE 6

| Ionic Liquid | % weight loss |
|---|---|
| none | 11 |
| $[N_{1,4,4,4}]_2$[Cys] | 8 |

Example 7

Corrosion Inhibition in Aqueous Acetic Acid by Surface Passivation

An immersion test was used to evaluate inhibition of anodic-induced corrosion of mild steel in the presence of basic ionic liquids.

A freshly cut mild steel coupon (~0.500 g) was degreased in absolute ethanol, dried in acetone, weighed, and immersed in 1 mL of a 0.01 M solution of $[P_{6,6,6,14}]_2$[Cys] in ethyl acetate for two hours. The coupon was then removed from the ionic liquid solution and dried in an oven at 140° C. for two hours. The ionic liquid doped coupon thus obtained was added to a glass-lined reactor containing a 5M aqueous solution of acetic acid (~10.000 g) and stirred at ambient temperature and atmospheric pressure for 24 hours. The coupon was carefully removed from the acid mixture, and gently washed with deionised water followed by 0.01 M HCl solution to remove any external corrosion. The coupon was then washed with distilled water followed by acetone and dried overnight at 80° C.

The same experiment was repeated using $[N_{1,4,4,4}]_2$[Cys] instead of $[P_{6,6,6,14}]_2$[Cys].

Control experiments were also carried out in which degreased, dried and weighed mild steel coupons were (a) added directly to the acetic acid solution; and (b) immersed in ethyl acetate containing no ionic liquid for two hours and dried as above, prior to being added to the acetic acid solution.

TABLE 7

| Ionic Liquid | % weight loss |
|---|---|
| None | 11 |
| None* | 12 |
| $[P_{6,6,6,14}]_2$[Cys] | 3 |
| $[N_{1,4,4,4}]_2$[Cys] | 2 |

*Mild steel coupon immersed in solvent containing no IL

Example 8

Corrosion Inhibition in Brine by Surface Passivation

An immersion test was used to evaluate inhibition of anodic-induced corrosion of mild steel in the presence of basic ionic liquids.

A freshly cut mild steel coupon (~0.500 g) was degreased in absolute ethanol, dried in acetone, weighed, and immersed in 1 mL of a 0.01 M solution of $[P_{66614}]_2$[Cys] in ethyl acetate for two hours. The coupon was then removed from the ionic liquid solution and dried in an oven at 140° C. for two hours. The ionic liquid doped coupon thus obtained was added to a glass-lined reactor containing a 10 wt % solution of NaCl in water (~10.000 g) and stirred at ambient temperature and atmospheric pressure for 72 hours. The coupon was carefully removed from the acid mixture, and gently washed with deionised water followed by 0.01 M HCl solution to remove any external corrosion. The coupon was then washed with distilled water followed by acetone and dried overnight at 80° C.

The same experiment was repeated using $[N_{1,4,4,4}]_2$[Cys] instead of $[P_{6,6,6,14}]_2$[Cys].

Control experiments were also carried out in which degreased, dried and weighed mild steel coupons were (a) added directly to the NaCl solution; and (b) immersed in ethyl acetate containing no ionic liquid for two hours and dried as above, prior to being added to the NaCl solution.

TABLE 8

| Ionic Liquid | % weight loss |
|---|---|
| None | 3.02 |
| None* | 4.26 |
| $[P_{6,6,6,14}]$[Cys] | 0.36 |
| $[N_{1,4,4,4}]_2$[Cys] | 0.27 |

*Mild steel coupon immersed in solvent containing no IL

The invention claimed is:

1. A method of inhibiting corrosion of a metallic surface in contact with a corrosive fluid, the method comprising adding to the corrosive fluid an ionic liquid having the formula:

$$[Cat^+][X^-—Z\text{-}Bas]$$

wherein: $[Cat^+]$ represents one or more cationic species;

$[X^-—Z\text{-}Bas]$ represents one or more anionic species wherein:

$X^-$ represents an anionic moiety;

Z is a covalent bond joining $X^-$and Bas, or a divalent linking group; and

Bas is a basic moiety, in an amount of from 1 to 5,000 ppm by weight, based on the total weight of the corrosive fluid.

2. A method according to claim 1, wherein $X^-$ represents a moiety selected from $—CO_2^-$ and $—SO_3^-$.

3. A method according to claim 1, wherein Bas represents a basic moiety which is the conjugate base of at least one member of a group consisting of: an acidic moiety having a $pK_a$ of 4.0 or greater and an acidic moiety having a $pK_a$ of less than 14.0.

4. A method according to claim 1, wherein Bas comprises at least one member of a group consisting of: basic nitrogen, phosphorus, sulfur, and oxygen atom.

5. A method according to claim 4, wherein Bas is selected from $—N(R^1)(R^2)$, $—P(R^1)(R^2)$, $—S(R^1)$, and $—O(R^3)$, wherein $R^1$, $R^2$, and $R^3$ are independently selected from linear or branched ($C_1$ to $C_8$) alkyl, ($C_1$ to $C_8$) cycloalkyl, ($C_6$ to $C_{10}$) aryl, ($C_6$ to $C_{10}$) aralkyl and ($C_6$ to $C_{10}$) substituted aryl.

6. A method according to claim 1, wherein Z is a divalent organic radical having from 1 to 18 carbon atoms, or a covalent bond.

7. A method according to claim 6, wherein Z has the formula $—(CH_2)_pCHR^4(CH_2)_q—$, wherein p+q is an integer of from 1 to 6, and $R^4$ represents a $C_1$ to $C_6$ straight chain or branched alkyl group.

8. A method according to claim 6, wherein $[X^-—Z\text{-}Bas]$ is selected from: alaninate, argininate, asparaginate, monoanionic aspartate, dianionic aspartate, cysteinate, monoanionic glutamate, dianionic glutamate, glycinate, histidinate, isoleucinate, leucinate, lysinate, methioninate, phenylalaninate, prolinate, serinate, threoninate, tryptophanate, tyrosinate, valinate, taurinate, and cystine.

9. A method according to claim 1, wherein $[Cat^+]$ represents one or more cationic species selected from: ammonium, benzimidazolium, benzofuranium, benzothiophenium, benzotriazolium, borolium, cinnolinium, diazabicyclodecenium, diazabicyclononenium, 1,4-diazabicyclo[2.2.2]octanium, diazabicyclo-undecenium, dithiazolium, furanium, guanidinium, imidazolium, indazolium, indolinium, indolium, morpholinium, oxaborolium, oxaphospholium, oxazinium, oxazolium, iso-oxazolium, oxothiazolium, phospholium, phosphonium, phthalazinium, piperazinium, piperidinium, pyranium, pyrazinium, pyrazolium, pyridazinium, pyridinium, pyrimidinium, pyrrolidinium, pyrrolium, quinazolinium, quinolinium, iso-quinolinium, quinoxalinium, quinuclidinium, selenazolium, sulfonium, tetrazolium, thiadiazolium, iso-thiadiazolium, thiazinium, thiazolium, iso-thiazolium, thiophenium, thiuronium, triazinium, triazolium, iso-triazolium, and uronium.

10. A method according to claim 9, wherein $[Cat^+]$ comprises a cationic species selected from:

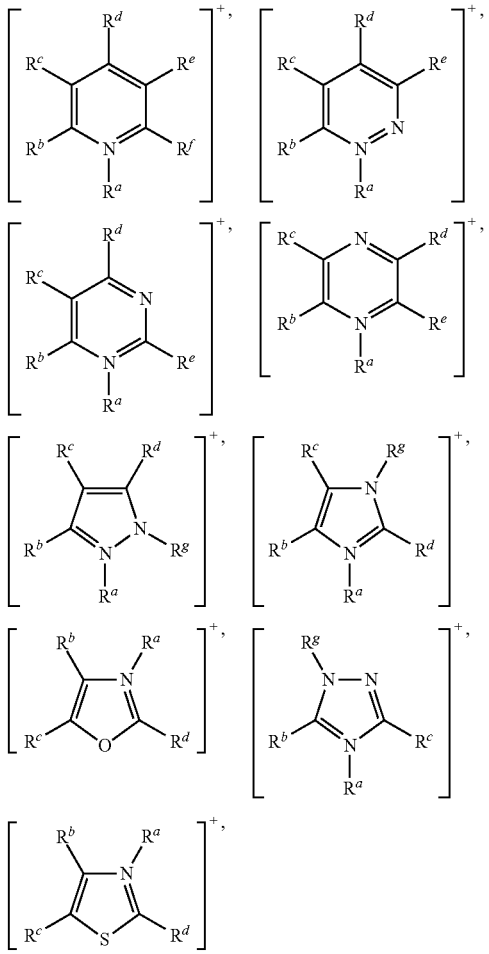

wherein: $R^a$, $R^b$, $R^c$,$R^d$, $R^e$, $R^f$ and $R^g$ are each independently selected from hydrogen, a $C_1$ to $C_{20}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain $—(CH_2)_q—$ wherein q is from 3 to 6; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, $—NO_2$, $—CO_2R^x$, $—OC(O)R^x$, $—C(O)R^x$, $—C(O)NR^yR^z$, $—NR^yR^z$, or a heterocyclic group, wherein $R^x$, $R^y$ and $R^z$ are independently selected from hydrogen or $C_1$ to $C_6$ alkyl; preferably wherein $[Cat^+]$ comprises or consists of a cationic species selected from:

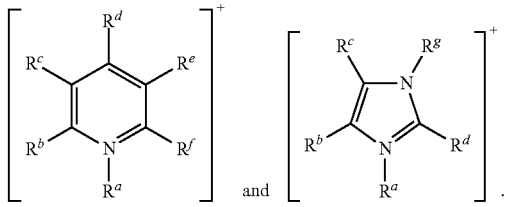

and

.

11. A method according to claim 9, wherein [Cat$^+$] comprises an acyclic cation selected from:

$$[N(R^a)(R^b)(R^c)(R^d)]^+,\ [P(R^a)(R^b)(R^c)(R^d)]^+,\ \text{and}\ [S(R^a)(R^b)(R^c)]^+,$$

wherein: $R^a$, $R^b$, $R^c$, and $R^d$ are each independently selected from a $C_1$ to $C_{20}$, straight chain or branched alkyl group, a $C_3$ to $C_8$ cycloalkyl group, or a $C_6$ to $C_{10}$ aryl group; and wherein said alkyl, cycloalkyl or aryl groups are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —OC(O)$R^x$, —C(O)$R^x$, —C(O)$NR^yR^z$, —$NR^yR^z$, or a heterocyclic group, wherein $R^x$, $R^y$ and $R^z$ are independently selected from hydrogen or $C_1$ to $C_6$ alkyl; and wherein one of $R^a$, $R^b$, $R^c$, and $R^d$ may be hydrogen; preferably wherein [Cat$^+$] comprises or consists of an acyclic cation selected from:

$$[N(R^a)(R_b)(R_c)(R_d]^+,\ [P(R_a)(R_b)(R_c)(R_d)]^+.$$

12. A method according to claim 1, wherein [Cat$^+$] comprises a basic cation having the formula:

[Cat$^+$-Z-Bas]

wherein: Cat$^+$represents a positively charged moiety, and Z and Bas are as defined in claim 3.

13. A method according to claim 12, wherein [Cat$^+$-Z-Bas] is selected from:

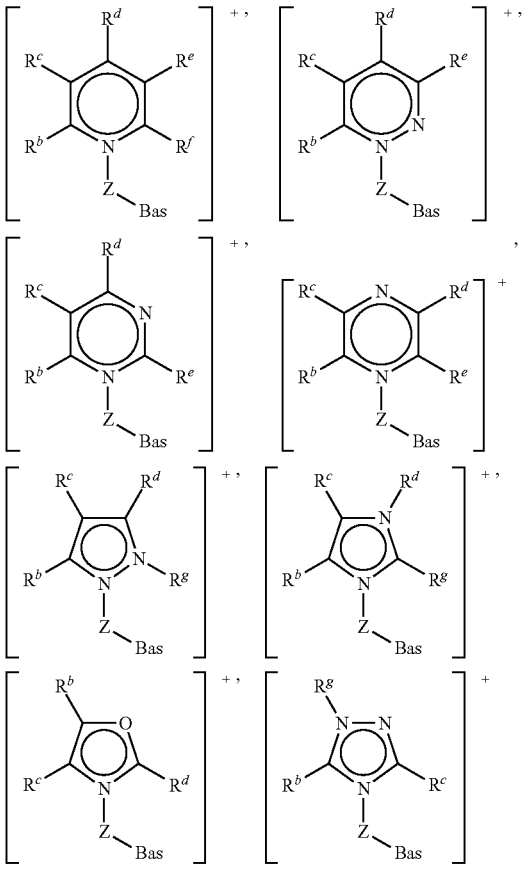

-continued

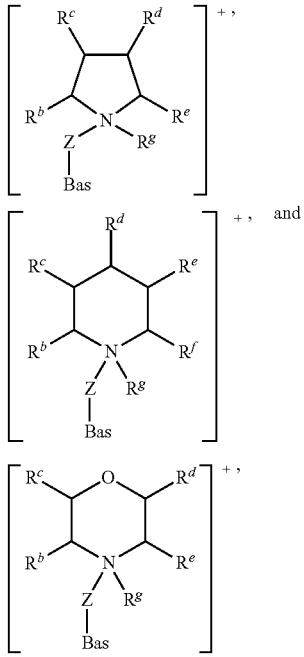

wherein: Bas and Z are as defined in claim 3; and $R^b$, $R^c$, $R^d$, $R^e$, $R^f$ and $R^g$ are independently selected from hydrogen, a $C_1$ to $C_{20}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain —$(CH_2)_q$— wherein q is from 3 to 6; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —OC(O)$R^x$, —C(O)$R^x$, —C(O)$NR^yR^z$, —$NR^yR^z$, or a heterocyclic group, wherein $R^x$, $R^y$ and $R^z$ are independently selected from hydrogen or $C_1$ to $C_6$ alkyl; or wherein [Cat$^+$-Z-Bas] is selected from:

$$[N(Z\text{-}Bas)(R^b)(R^c)(R^d)]^+\ \text{and}\ [P(Z\text{-}Bas)(R^b)(R^c)(R^d)]^+$$

wherein: Bas and Z are as defined in claim 1, and $R^b$, $R^c$, and $R^d$ are independently selected from a $C_1$ to $C_{20}$, straight chain or branched alkyl group, a $C_3$ to $C_8$ cycloalkyl group, or a $C_6$ to $C_{10}$ aryl group, or any two of $R^b$, $R^c$, $R^d$, $R^e$ and $R^f$ attached to adjacent carbon atoms form a methylene chain —$(CH_2)_q$—wherein q is from 3 to 6; and wherein said alkyl, cycloalkyl or aryl groups or said methylene chain are unsubstituted or may be substituted by one to three groups selected from: $C_1$ to $C_6$ alkoxy, $C_2$ to $C_{12}$ alkoxyalkoxy, $C_3$ to $C_8$ cycloalkyl, $C_6$ to $C_{10}$ aryl, $C_7$ to $C_{10}$ alkaryl, $C_7$ to $C_{10}$ aralkyl, —CN, —OH, —SH, —$NO_2$, —$CO_2R^x$, —OC(O)$R^x$, —C(O)$R^x$, —C(O)$NR^yR^z$, —$NR^yR^z$, or a heterocyclic group, wherein $R^x$, $R^y$ and $R^z$ are independently selected from hydrogen or $C_1$ to $C_6$ alkyl; and wherein one of $R^b$, $R^c$, and $R^d$ may be hydrogen.

14. A method according to claim 1, wherein the ionic liquid has a melting point of less than 150 ° C.

15. A method according to claim 1, wherein the basic ionic liquid is added to the corrosive fluid in an amount of from 10 to 2,000 ppm by weight, based on the total weight of the corrosive fluid.

16. A method of inhibiting corrosion of a metallic surface in contact with a corrosive fluid, the method comprising forming a dopant layer of an ionic liquid having the formula:

$$[Cat^+][X^-—Z\text{-}Bas]$$

wherein: $[Cat^+]$ and $[X^-—Z\text{-}Bas]$ are as defined in claim 1;

on the metallic surface prior to contacting the metallic surface with the corrosive fluid.

17. A method according to claim 1, wherein the corrosive fluid is an acid-containing hydrocarbon fluid.

18. A method according to claim 17, wherein the acid-containing hydrocarbon fluid comprises at least one member of a group consisting of: naphthenic acids and sulfur-containing acids.

19. A method according to claim 1, wherein the corrosive fluid is an acid-containing aqueous fluid having a pH of less than about 7.0.

20. A method according to claim 1, wherein the corrosive fluid is an aqueous solution of at least one salt.

21. A method according to claim 1, wherein the metallic surface is the surface of a reactor vessel or distillation vessel.

22. A method of distilling an acid-containing hydrocarbon fluid feed using a distillation apparatus having a metallic surface in contact with the acid-containing hydrocarbon fluid, the method comprising adding a basic ionic liquid having the formula:

$$[Cat^+][X^-—Z\text{-}Bas]$$

to the acid-containing hydrocarbon fluid feed, wherein $[Cat^+]$ and $[X^-—Z\text{-}Bas]$ are as defined in claim 1.

23. A method according to claim 22, wherein the acid-containing hydrocarbon fluid is as defined in claim 18.

* * * * *